US006679620B2

(12) United States Patent
Patz et al.

(10) Patent No.: US 6,679,620 B2
(45) Date of Patent: Jan. 20, 2004

(54) LIGHT FIXTURE

(75) Inventors: Jason D. Patz, Jacksonville, FL (US); Robert E. Wilson, Atlantic Beach, FL (US); Robert J. Pape, Ponte Vedra Beach, FL (US); Brian S. Sibson, Jacksonville, FL (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 10/122,470

(22) Filed: Apr. 12, 2002

(65) Prior Publication Data

US 2003/0193810 A1 Oct. 16, 2003

(51) Int. Cl.[7] ..... F21V 27/00
(52) U.S. Cl. ..... 362/308; 362/404; 362/407
(58) Field of Search ..... 362/387, 404, 362/407, 403, 405, 406, 147, 432, 249, 806

(56) References Cited

U.S. PATENT DOCUMENTS 741,154 A * 10/1903 Meyer ..... 362/404
2,753,445 A * 7/1956 Thomas et al. ..... 362/404
4,079,244 A 3/1978 Bortoluzzi ..... 362/405
4,528,620 A 7/1985 Weber ..... 362/86
5,111,370 A 5/1992 Clark ..... 362/147
5,249,107 A * 9/1993 Poulsen ..... 362/249
5,376,020 A 12/1994 Jones ..... 439/537
6,296,377 B1 10/2001 Wilson et al. ..... 362/370

* cited by examiner

*Primary Examiner*—Sandra O'Shea
*Assistant Examiner*—Bao Truong
(74) *Attorney, Agent, or Firm*—Baker Donelson

(57) ABSTRACT

A light fixture (10) is disclosed which includes junction box (11), an annular mounting plate, a canopy (21), a collar loop (23), a collar nut (25) and a light assembly (34) which includes a length of electric cord (41). The canopy (21) includes an outer shell (29) and central winding spool (30) which is mounted concentrically within the canopy outer shell (29) and concentrically about a mounting opening (22) within the canopy (21). The central winding spool (30) has a generally cylindrical central portion (31) and an annular flange portion (32) extending from the top of the central portion (31). The slack portion of the electric cord (41) may be wound about the winding spool (30) in order to stow it in a safe and efficient manner.

9 Claims, 3 Drawing Sheets

LIGHT FIXTURE

TECHNICAL FIELD

This invention relates generally to light fixtures, and more particularly to light fixtures having the ability to store extra lengths of electrical wiring.

BACKGROUND OF THE INVENTION

Light fixtures which may be mounted to the planar surface of a ceiling or wall have existed for many years. These light fixtures typically include a mounting plate which is mounted directly to the wall or ceiling, a threaded mounting post or nipple extending from the mounting plate, a canopy or otherwise decorative plate which is mountable upon the mounting plate through the mounting post and a threaded nut received upon the mounting post, and a light assembly which is coupled to the canopy. The light assembly may include one of more light sockets and decorative arms, housings, encasements, mounting chains and the like. The electric sockets are coupled to an elongated electric cord which is coupled to an electric power line positioned adjacent the mounting plate.

In the past, light fixtures such as chandeliers have been mounted by supporting the light assembly below the previously mounted mounting plate so that the electric cord may be connected to the electric power line within the ceiling. The canopy is then raised and mounted to the mounting plate with the mounting post extending through a hole in the mounting plate. The electric cord is typically passed through the hollow center of the mounting post. A nut is then threaded upon the mounting post whereby the weight of the light assembly is supported by the mounting post.

The distance between the light assembly and the mounting plate may vary, as with a chandelier having a chain which is cut to the appropriate length according to the height of the ceiling. Prior to mounting the light assembly any extra length of the electric cord may be coiled and stored within the canopy. However, should this length of extra electric cord be length the installer may have difficulty placing the entire length within the canopy. Furthermore, the cord must be positioned in such as manner as to enable the passage of the mounting post through the canopy and through the hole within the canopy. This may be problematic as the electric cord oftentimes blocks the canopy hole. If this occurs, the electric cord must be manually repositioned. Also, if the operator were to force the canopy upward with the mounting hole blocked the mounting post may damage the electric cord, thereby creating a potential hazard.

Furthermore, in raising the light assembly to its final mounted position there is usually another slack length of electric cord that must be dealt with to provide an aesthetically pleasing appearance. The same problem previously recited with reference to the extra length of electric cord again arises.

As an alternative, the electric cord has oftentimes been pushed back through the hollow mounting post so that it is stowed within the recess within the ceiling. This recess usually provides only a limited amount of space and therefore it may not be able to accommodate the entire length of slack portion. As such, the electric cord is oftentimes bent and stowed within the canopy prior to the final movement in mounting the canopy to the mounting plate. This process however sometimes places the electric cord in a position which blocks the passage of the mounting post through the canopy and through the hole within the bottom of the canopy, i.e., the electric cord may block the mounting hole in the canopy.

Accordingly, it is seen that a need remains for a light fixture which will enable the electric cord associated with the lighting assembly to be stowed in a safe and efficient manner. It is to the provision of such therefore that the present invention is primarily directed.

SUMMARY OF THE INVENTION

In a preferred form of the invention a light fixture mountable to a planar surface comprises a mounting plate mounted to a generally planar surface, a post extending from the mounting plate, a covering plate adapted to be mounted to the mounting plate, a fastener configured to mate with said post, at least one light socket coupleable to the covering plate, and an elongated electric cord electrically coupled to the light socket. The covering plate has an outer shell with a mounting hole therein sized and shaped to receive said post and a winding spool positioned within the outer shell With this construction, a length of the electric cord may be wrapped about the spool to stow any excess amount of the electric cord.

DETAILED DESCRIPTION

Figure 1:
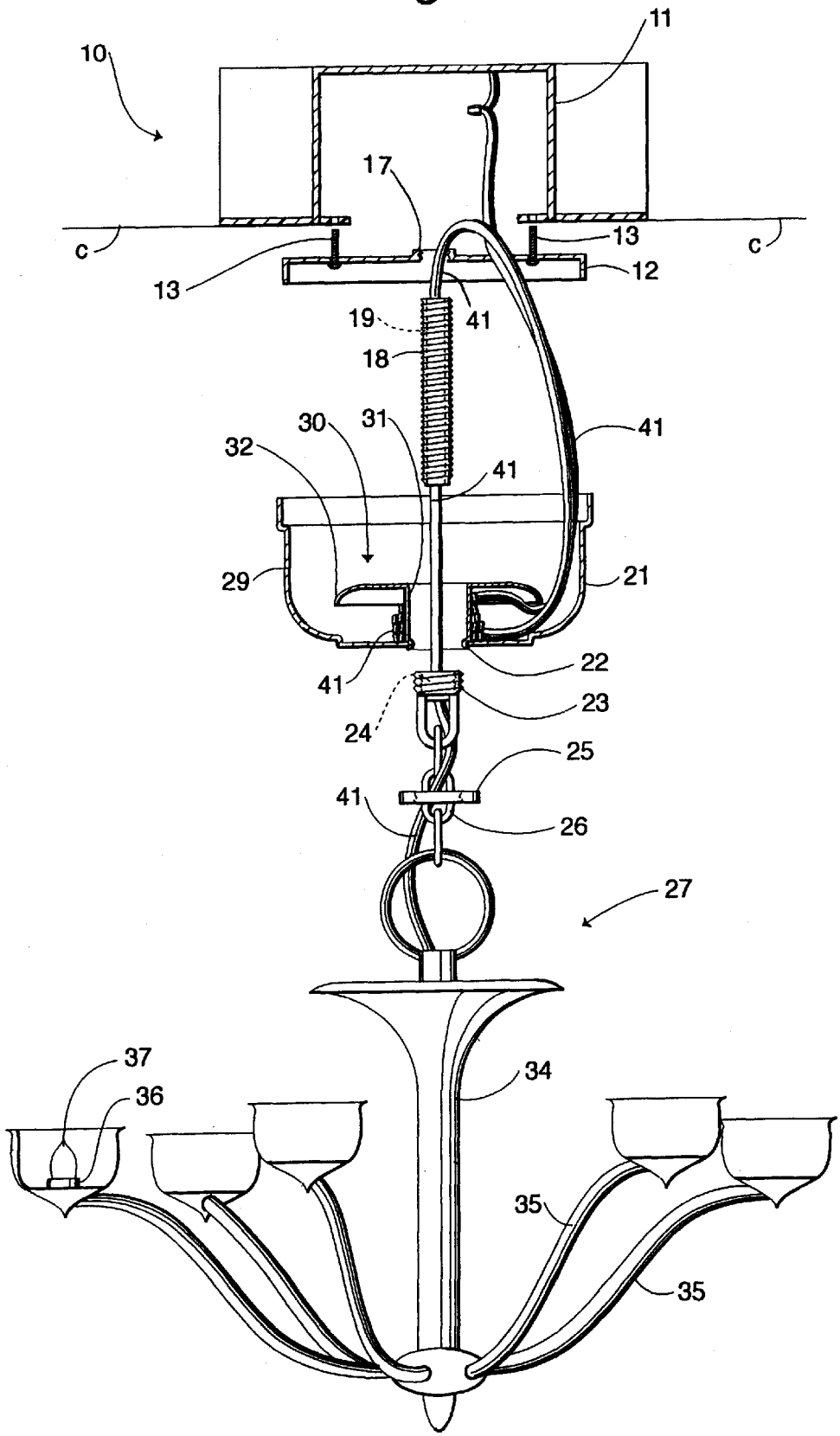
FIG. 1 is an exploded, side view of a light fixture embodying principles of the invention in a preferred form.
Figure 2:
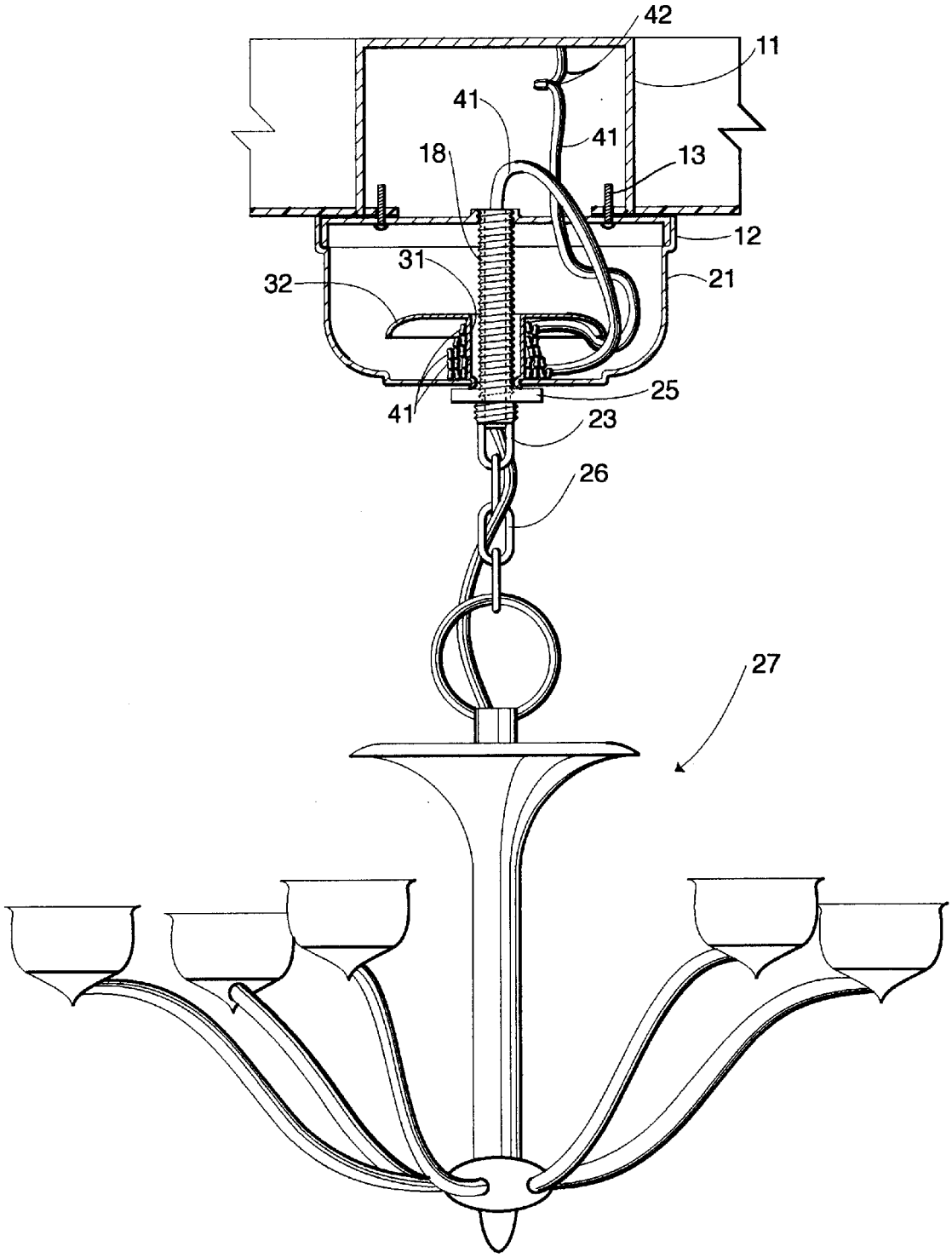
FIG. 2 is a side view of the light fixture of FIG. 1 shown in an assembled configuration.
Figure 3:
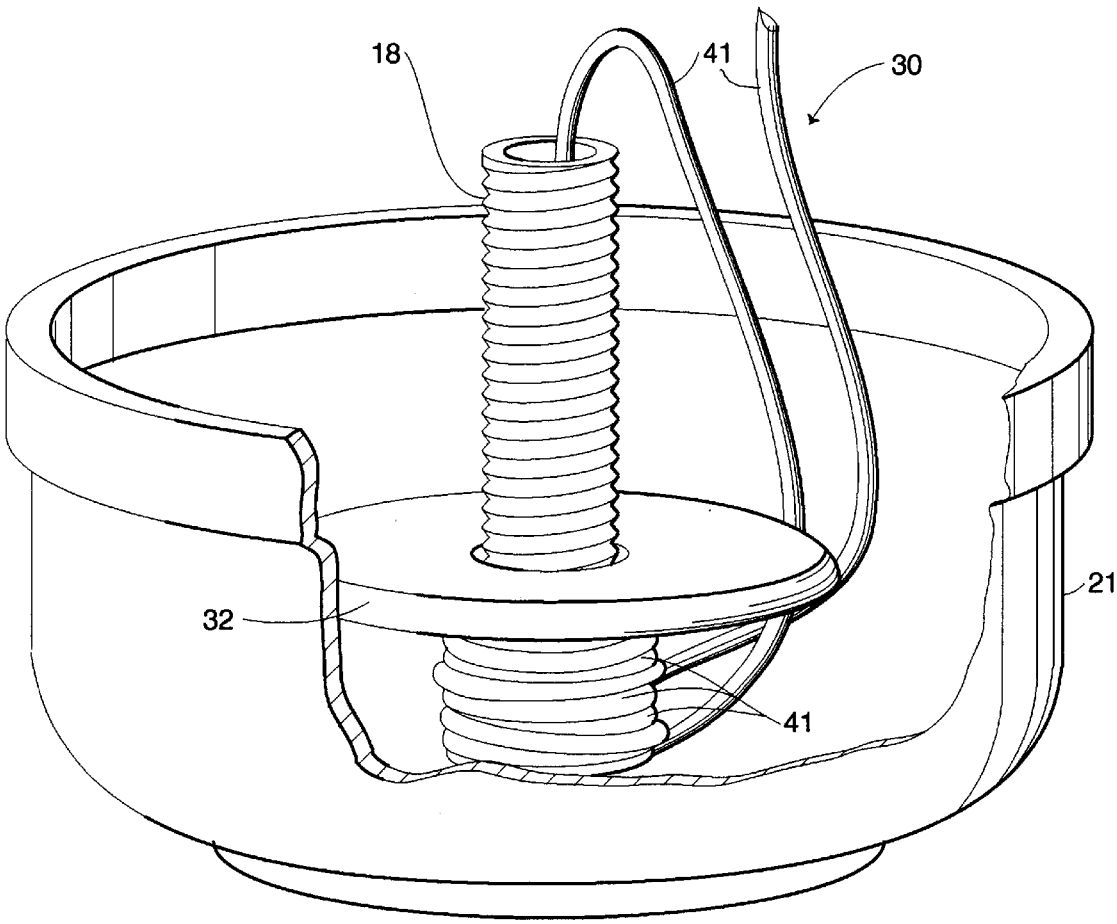
FIG. 3 is a perspective view, in partial cross-section, of the canopy portion of the ceiling fan of FIG. 1.

With reference next to the drawings, there is shown a light fixture 10 suspended from a ceiling c in a preferred form of the invention. The light fixture includes junction box 11 which is fixed to the ceiling c and an annular mounting plate 12 coupled to the junction box 11 through a pair of mounting screws 13 extending through mounting holes 14 within the mounting plate and threadably received within threaded mounting holes 15 within the junction box 11. The mounting plate 12 has a central, internally threaded mounting hole 17 adapted to receive an externally threaded mounting post or nipple 18 having a central bore 19, so that the mounting post 18 depends from the mounting plate 12.

The light fixture 10 also includes a bowl shaped covering plate or canopy 21 having a central opening 22 therein, a screw collar loop 23 having a bore 24 with internal threads adapted to threadably receive mounting post 18 and external threads adapted to threadably mate with an internally threaded collar nut 25. A length of chain 26 is coupled at one end to the collar loop 23 and coupled at an opposite end to a lighting assembly 27. The canopy 21 includes an outer shell 29 and central winding spool 30 which is mounted concentrically within the canopy outer shell 29 and concentrically about the mounting opening 22. The central spool 30 has a generally cylindrical central portion 31 and an annular flange portion 32 extending outwardly from the top of the central portion 31. The flange portion 32 has a down-turned edge to prevent sharp edges from damaging the electric cord describe in more detail hereunder and to maintain an electric cord wound about the central portion 31.

The lighting assembly 27 includes a central hub 34 and a plurality of arms 35 extending from the central hub 34. Upon the end of each arm 35 is mounted an electric socket 36 adapted to receive a light bulb 37. The sockets 36 are electrically coupled to a common electric cord 41 which may extend from the top of the hub and be passed through the links of the chain 26. The electric cord 41 passes through the central bore 24 of the collar loop 23, through the central opening 22 in the canopy 21, through the central bore 19 within the mounting post 18 and into the junction box 11. Within the junction box 11 the ends of the electric cord 41 are connected to the ends of an electric power line 42 carrying an electric current. The electric cord 41 is wrapped about the spool 30 as described in more detail hereunder. It should be understood that the light assembly may be in the form of any type of light fixture and is not intended to be limited to the chandelier style shown in the preferred embodiment.

In use, the junction box 11 is mounted to a ceiling joist of other surface so that the junction box 11 is preferably positioned adjacent a generally planar mounting surface such as a ceiling c. With the chain being cut to a desired length any slack or extra portion of the electric cord 41 may be wound about the spool 30 prior to the mounting post 18 being threaded into the central mounting hole 17. The electric cord is wound about the spool by doubling the cord and passing it beneath the spool flange 32, whereby the down turned edge restricts the electric cord from moving outboard.

The mounting plate 12 is then mounted to the junction box 11 by passing mounting screws 13 through the mounting plate mounting holes 14 and threading them into the junction box mounting holes 15. The mounting post 18 is then threaded into the central mounting hole 17 within the mounting plate so as to extend a select distance that will expose an end portion of the mounting post past the canopy 21 when the canopy is in its final position. Once the mounting post 18 is properly positioned, with the chain 26 passing through the canopy central opening 22 and the collar nut 25, the collar loop 23 is threaded onto the mounting post 18, thereby supporting the accompanying chain 26 and lighting assembly 27, i.e., the chain is positioned through the central opening 22 in the canopy and through the collar nut 25 prior to the collar loop 23 being threaded onto the mounting post 18. The electric cord 41 thus passes through the links of the chain, through the bore 24 of the collar loop, through the bore 19 of the mounting post and through the central opening 17 in the mounting plate. The end of the electric cord 41 is then connected to the exposed end of the electric power line 42 running into the junction box 11.

To enable one to connect the end of the electric cord 41 to the end of the electric power line 42 there must be enough slack in the electric power line 42 to enable it to be pulled partially from the junction box 11 and manually manipulated. The electric cord 41 may also have a slack or extra portion to enable the installer to manipulate it during the connecting process. This slack or extra portion of electric cord 41 may also be manually wound about the spool 30 in the same manner as previously described. Again, the flange 32 of the spool prevents the wound portion of the electric cord 41 from springing back inside the top portion of the canopy 21. As such, the extra portion of the electric cord 41 is stowed in a manner by which is will not interfere with the mounting post 18 as it is directed through the canopy during canopy mounting. This insures an efficient mounting of the canopy 21 and insures that the mounting post will not damage the electric cord 41 during the mounting process.

Once the extra portion of electric cord 41 is wound upon the spool 30 and the canopy raised to final position, the collar nut 25 is raised and threaded upon the external threads of the collar loop 23. The collar nut 25 is threaded to the collar loop 23 to a position wherein it abuts the bottom of the canopy, thereby securing the canopy in place.

It should be understood that the spool 30 may be offset from the canopy mounting hole 17. Also, it should be understood that the mounting plate 12 may be mounted directly to the planar support structure, such as a wall or ceiling, without the need of a junction box. It should also be understood that the spool 30 may take on many different configuration. For instance, the spool may be comprised of a plurality of radially extending spokes rather than the solid surface shown in the preferred embodiment.

It should also be understood that the word canopy used herein may refer to any covering plate or fixture portion that is coupled to a mounting plate and is not limited to a canopy shown in the preferred embodiment. Furthermore, the light fixture may be in the form of a light fixture which is mounted to a wall rather than a ceiling, such as a sconce or lantern. As such, the term canopy or covering plate may be in the form of a plate covering a mounting plate mounted to a wall.

It should also be understood that the spool may be provide with a notch in which to mount the electric cord 41, or otherwise configured to hold or engage the electric cord, so that the canopy may be rotated or spun to wind the extra portion of electric cord 41 upon the spool 30.

Lastly, it should be understood that the just described embodiment may also include a quick connect connectors within the electric cord, as shown in U.S. Pat. No. 6,322,232, which may ease the winding of the cord when the connectors are disconnected from each other.

It thus is seen that a ceiling fan having lighting capabilities is now provided which overcomes problems with those of the prior art. While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. A light fixture mountable to a planar surface comprising:

a mounting plate mounted to a generally planar surface;

a post extending from said mounting plate;

a covering plate adapted to be mounted to said mounting plate, said covering plate having an outer shell with a mounting hole therein sized and shaped to receive said post and a winding spool positioned within said outer shell, said winding spool having an open periphery and configured to releasably receive a length of an electric cord;

a fastener configured to mate with said post;

at least one light socket coupleable to said covering plate; and an elongated electric cord electrically coupled to said light socket, whereby a length of the electric cord may be wrapped about the spool to stow any excess amount of the electric cord.

2. The light fixture of claim 1 wherein said spool is positioned concentrically about said mounting hole.

3. The light fixture of claim 1 wherein said spool is mounted concentrically within said covering plate.

4. The light fixture of claim 1 wherein said spool has a tubular central portion positioned about said mounting hole and a flange extending from said central portion.

5. In a light fixture having a mounting plate, a covering plate mounted to the mounting plate, a light assembly coupled to the covering plate, and an elongated electric cord coupled to the lighting assembly, the improvement comprising a winding spool positioned within said covering plate, said winding spool being configured to releasably receive and hold a length of the elongated electric cord, whereby the slack portion of the electric cord may be wound about the winding spool and stowed within the covering plate.

6. The improvement of claim 5 wherein said covering plate has a mounting hole therein and wherein said spool is positioned concentrically about said mounting hole.

7. The light fixture of claim 5 wherein said spool is mounted concentrically within said covering plate.

8. The light fixture of claim 6 wherein said spool has a tubular central portion positioned about said mounting hole and a flange extending from said central portion.

9. A method of mounting a light fixture having a mounting plate, a cover plate mountable to the mounting plate, a light assembly mountable to the cover plate, and an elongated electric cord coupled to the light assembly, the method comprising the steps of:

(a) providing a winding spool within said cover plate;

(b) mounting the mounting plate to a mounting surface;

(c) winding a portion of the electric cord about the winding spool prior to coupling the cover plate to the mounting plate;

(d) coupling the cover plate to the mounting plate with a portion of the electric cord wound about the winding spool.

* * * * *